US008677958B2

(12) United States Patent
Becker et al.

(10) Patent No.: US 8,677,958 B2
(45) Date of Patent: Mar. 25, 2014

(54) SWITCHABLE LEVER FOR A VALVE DRIVE OF AN INTERNAL COMBUSTION ENGINE

(75) Inventors: Matthias Becker, Herzogenaurach (DE); Robert Heinemann, Fuerth (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 324 days.

(21) Appl. No.: 13/099,817

(22) Filed: May 3, 2011

(65) Prior Publication Data

US 2011/0265751 A1 Nov. 3, 2011

(30) Foreign Application Priority Data

May 3, 2010 (DE) ..... 10 2010 019 064

(51) Int. Cl.
*F01L 1/34* (2006.01)
*F01L 1/18* (2006.01)

(52) U.S. Cl.
USPC ..... 123/90.16; 123/90.44; 123/90.39

(58) Field of Classification Search
USPC ..... 123/90.15–90.17, 90.39, 90.27, 90.44, 123/90.48, 90.55, 90.59
See application file for complete search history.

(56) References Cited

U.S. PATENT DOCUMENTS

| | | | | |
|---|---|---|---|---|
| 4,352,344 | A * | 10/1982 | Aoyama et al. | 123/90.18 |
| 5,743,226 | A * | 4/1998 | Tohdoh et al. | 123/90.16 |
| 7,350,486 | B1 * | 4/2008 | Wu et al. | 123/90.16 |
| 7,980,211 | B2 * | 7/2011 | Ihlemann | 123/90.16 |
| 7,980,217 | B2 * | 7/2011 | Evans et al. | 123/90.6 |
| 8,006,657 | B2 * | 8/2011 | Riley et al. | 123/90.11 |
| 2001/0035140 | A1 * | 11/2001 | Fernandez et al. | 123/90.15 |
| 2005/0061274 | A1 * | 3/2005 | Nakahira | 123/90.16 |
| 2007/0186890 | A1 * | 8/2007 | Zurface et al. | 123/90.44 |
| 2009/0095241 | A1 * | 4/2009 | Ihlemann | 123/90.16 |
| 2011/0226209 | A1 * | 9/2011 | Zurface et al. | 123/90.44 |
| 2011/0265750 | A1 * | 11/2011 | Becker et al. | 123/90.39 |
| 2011/0265751 | A1 * | 11/2011 | Becker et al. | 123/90.39 |
| 2012/0325168 | A1 * | 12/2012 | Nitz et al. | 123/90.17 |

* cited by examiner

*Primary Examiner* — Thomas Denion
*Assistant Examiner* — Steven D Shipe
(74) *Attorney, Agent, or Firm* — Lucas & Mercanti, LLP

(57) ABSTRACT

A switchable lever for a valve drive of an internal combustion engine, which has an elongated housing with two side walls. A crossbar for a gas-exchange valve system and another end of the housing has a hearing for pivotable support of the crossbar. An axle is held nondisplaceably in the side walls. An axially fixed low-lift cam roller is seated centrally on the axle and is flanked on both sides by a high-lift cam roller. The high-lift cam rollers are displaceable: (a) into a first position, away from each other, to toward the side walls such that contact of one high-lift cam per high-lift cam roller is possible, and (b) into a second position, toward each other, such that they are located outside an engagement region of the high-lift cams, and as a result of which contact of a low-lift or zero-lift cam with the low-lift cam roller is possible.

20 Claims, 2 Drawing Sheets

SWITCHABLE LEVER FOR A VALVE DRIVE OF AN INTERNAL COMBUSTION ENGINE

CROSS-REFERENCE TO RELATED APPLICATION

This application claims the priority of DE 10 2010 019 064.0 filed May 3, 2010, which is incorporated by reference herein.

FIELD OF THE INVENTION

The invention relates to a switchable lever for a valve drive of an internal combustion engine.

BACKGROUND OF THE INVENTION

The lever revealed in subsequently published DE 102010011828.1 is considered to be the closest prior art. It is noticeable that the axle has to be acted upon in a complicated manner via external means in order to be displaced. In association therewith, the abovementioned lever requires a relatively large amount of construction space laterally, and, at least in the switching state shown in FIG. 5, an asymmetrical introduction of force occurs during the cam lift. It is also ascertained that the central region of the lever has a relatively large bulge because of the displaceable cam rollers positioned next to one another on the axle.

It is therefore the object of the invention to develop the lever of the type mentioned at the beginning to the effect that said lever no longer has the disadvantages described.

SUMMARY OF THE INVENTION

The invention is directed to a switchable lever for a valve drive of an internal combustion engine, which has an elongated housing with two side walls. One of the ends of the housing has a crossbar for a gas-exchange valve system and another one of the ends of the housing has a bearing for pivotable support of the crossbar. An axle is held in the side walls between the ends. At least two cam rollers run on the axle. The cam rollers are displaceable relative to each other into a first position via a first means and are displaceable away from each other into a second position via a second means. One of the positions serves for a high-lift cam contact [switching to a large valve lift] and the other of the positions serves for a low-lift or zero-lift cam contact [switching to a low or 0 valve lift].

More specifically, the object is achieved in that the axle is held axially fixed in the side walls and precisely three cam rollers are used. An axially fixed low-lift cam roller is seated centrally on the axle as one of the three rollers. The low-lift cam roller is flanked on both sides by mutually identical high-lift cam rollers as the other two rollers. The high-lift cam rollers are displaceable: (a) away from each other to the side walls into the first position via the first means such that contact of one high-lift cam per high-lift cam roller is possible, and (b) toward each other into a second position via a second means such that they are located outside an engagement region of the high-lift cams, as a result of which in this case only contact of a low-lift or zero-lift cam with the low-lift cam roller is possible.

A lever is therefore present without the disadvantages referred to at the beginning. A particularly outstanding feature of the invention is the ultimately telescopic nesting of the three cam rollers, thus making it possible to save on construction space laterally. At the same time, forces are introduced into the lever symmetrically during the cam lift such that the lever has only an insignificant tilting tendency, if any at all. The cam rollers, in particular the high-lift cam rollers, can be physically relatively broad such that the loading on the components by the surface pressure is minimized. In addition, simple internal actuating means are proposed for the cam rollers for the displacement thereof (hydraulic medium/compression spring), and separate pressure spaces for the hydraulic medium can be omitted, as can separate coupling means, owing to the pressure spaces being formed axially between the cam rollers. It is obvious that this simultaneously provides excellent lubrication of the sealing rotary tapping between the inner annular casing of the low-lift cam roller and a diameter step, which runs therein, of the respective high-lift cam roller.

Displacement of the high-lift cam rollers into both positions via hydraulic medium is optionally also possible. Alternative actuating means for displacing the high-lift cam rollers counter to the pressure of hydraulic medium, such as magnetic or electromagnetic means etc., are also conceivable.

In the second, retracted position, each high-lift cam roller is held in sections by the inner diameter step thereof in a sealing manner in an annular casing of a pocket of the low-lift cam roller. Hydraulic medium from the circuit of the internal combustion engine is preferred as the first servo means for producing the first, extended position. However, brake fluid or a separate hydraulic medium circuit may also be used.

At least one co-rotating helical compression spring clamped indirectly between the high-lift cam roller and the side wall of the lever is proposed per high-lift cam roller as the spring means (second servo means) for producing the second, retracted position, with other types of springs, such as disk springs, etc., also being possible. The respective helical compression spring expediently sits in an annular pocket of an outer face of the high-lift cam roller, thus saving construction space.

It is advantageous here to place the corresponding annular pocket to be radially lower than the inner diameter step of the high-lift cam roller, such that there is sufficient construction depth.

According to another expedient embodiment, each high-lift cam roller should be seated fixedly on a pipe section which runs rotatably on the axle. The pipe section, via the collar thereof, which is located axially on the outside, provides a simple support at the other end for the spring means. The collar therefore rotates in relation to the side wall, with there being good lubrication here via hydraulic medium from the pressure chamber, oil spray and oil mist. Separate wear protection measures, such as coatings, may optionally also be taken.

Axially on the inside, the abovementioned pipe section, which is composed, for example, of sheet metal, has simple, crown-like apertures, thus permitting an unobstructed overflow of the hydraulic medium out of the axle into the respective pressure space.

A further embodiment relates to measures for supplying the hydraulic medium to the pressure space. It has proven particularly expedient to introduce the hydraulic medium for the lever from the bearing, which bearing can be designed as a dome for a head of a supporting element. Hydraulic medium is conducted in a simple manner via, for example, drilled transverse and longitudinal charnels and a rotary tapping on the axle into the axle and from there to the pressure spaces. If the lever is not to be produced from steel sheet by punching and bending, but rather, for example, is to be cast, the channels may also be cast therein at the same time. It is also conceivable for the transverse and longitudinal channels to be formed separately and retrospectively arranged on the outer casing of the lever. The hydraulic medium can optionally also be conducted laterally onto the axle directly via hoses.

Furthermore, according to another expedient physical embodiment of the invention, the low-lift cam roller, which may also run counter to a zero-lift cam or a support circle, is fixed centrally on the axle via inner faces of the abovementioned pipe section. Of course, snap rings or radial cast-on flanges are also conceivable and provided at this point on the axle, which axle may optionally also be assembled.

Primarily, but not exclusively, either a rocker arm lever which can be mounted on a supporting element, or an oscillating lever which can be arranged on an oscillating axis, are possible as the cam-following lever. Given a sufficient amount of construction space, the roller sliding system proposed may also be used on a tilting lever or roller tappet.

Owing to the optionally provided support surfaces, for example on upper sides of the side walls, the lever can be supported as it passes through the cam base circle such that the respective cam base circles are free from contact with the cam rollers, which minimizes the effort expended on displacing the latter. Possible mating support surfaces include, for example, support cams on the cam shaft or elements which protrude from the cylinder head and project beyond the side walls.

BRIEF DESCRIPTION OF THE DRAWINGS

The invention is explained with reference to the drawing, in which.

DETAILED DESCRIPTION OF THE INVENTION

Figure 1:
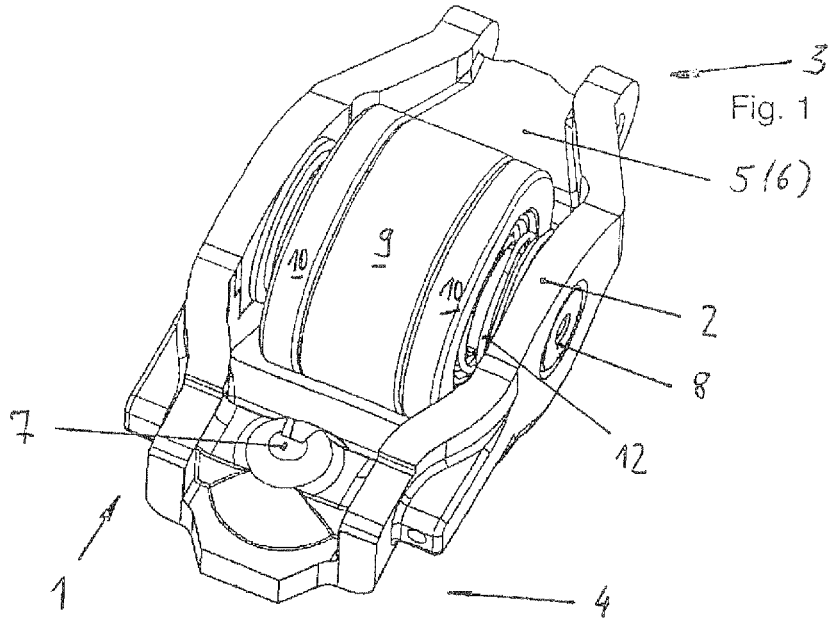
FIG. 1 shows a spatial view of the lever according to the invention.

A switchable lever 1 in the form of a rocker arm lever for a valve drive of an internal combustion engine is illustrated. Said lever has a box-shaped geometry in top view and consists of two upright side walls 2, the ends 3, 4 of which are connected on their lower side by a cross bar 5. The side walls 2 have an expanded center section 37, which expanded center section 37 is adjoined by intermediate sections 38 which face each other and peter out in rectilinear end sections 39.

There is a gas-exchange valve system 6 in the crossbar 5 at the one end 3 and a bearing 7, which is designed as a dome-shaped formation and is intended for the pivotable supporting of the lever 1, at the other end 4. An axle 8 is held nondisplaceably in the side walls 2 between the ends 3, 4. Two axially displaceable high-lift cam rollers 10, which enclose a low-lift cam roller 9, run on said axle.

FIGS. 4, 5:

The low-lift cam roller 9 has a cylindrical pocket 14 on both end sides 13, and each high-lift cam roller 10 has two diameter steps 15, 16, of which the axially outer diameter step 15 serves for the high-lift cam contact and the axially inner diameter step 16, which is smaller in diameter than the outer diameter step, is mounted together in sections with an annular casing 17 of the respective pocket 14 of the low-lift cam roller 9 "in a sucking manner."

A pressure space 20 for hydraulic medium, which can be introduced via the axle 8, is produced axially between a base 18 of the respective pocket 14 and an inner face 19 of the adjacent high-lift cam roller 10 as the first servo means 11. A mechanical spring means is clamped indirectly between an outer face 21 of the respective high-lift cam roller 10 and the adjacent side wall 2 as the second servo means 11, wherein a first position (see FIG. 5) can be produced counter to the force of the spring means 12 by high pressure at the hydraulic medium 11, which can be conducted into the pressure space 20, and a second position (see FIG. 4) can be produced by the force of the spring means 12, with the high pressure at the hydraulic medium 11 switched off.

In addition, it is illustrated that a concentric annular pocket 22 is inserted in the outer face 21 of the corresponding high-lift cam roller 10, and the spring means 12, which is present in the form of at least one helical compression spring, is supported at one end of the bottom 23 of said annular pocket. The annular pocket 22 is positioned in a radial region below the inner diameter step 16 of the high-lift cam roller 10.

Figure 3:
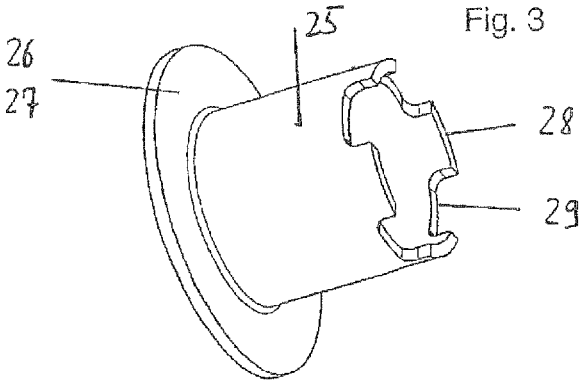
FIG. 3 shows a spatial view of the pipe section for the mounting of the respective high-lift cam rollers.

Each high-lift cam roller 10 is seated with the bore 24 thereof non-rotatably on a pipe section 25 (also see FIG. 3) which rotates on the axle 8 and merges axially on the outside into a radial collar 26 bearing against the side wall 2. Spring means 12 is supported on the outside on an inner side 27 of the radial collar 26, wherein the low-lift cam roller 9, for the central positioning thereof on the axle 8, is held between inner faces 28 of the pipe section 25. As FIG. 3 discloses, for example, in conjunction with FIG. 5, the inner face 28 of each pipe section 25 is provided with crown-like apertures 29 for an overflow of hydraulic medium 11 into the pressure space 20.

FIG. 2:

A supply line for the hydraulic medium is provided in the lever 1. Said supply line starts from the bearing 7 at the other end 4 and consists of a transverse channel 34 in the crossbar 5. The transverse channel 34 opens at an outer end into a longitudinal channel 35 of the side wall 2, which longitudinal channel 35 communicates with an annular-groove/bore overflow 36 in the axle 8. The supply line is conducted further from said overflow 36 to an axial channel 30 in the axle 8, from which axial channel one radial channel 31 branches off per pressure space 20, the radial channel being positioned axially close to the base 18 of the pocket 14 of the low-lift cam roller 9 and ultimately leading into the pressure space 20 through the apertures 29.

Figure 2:
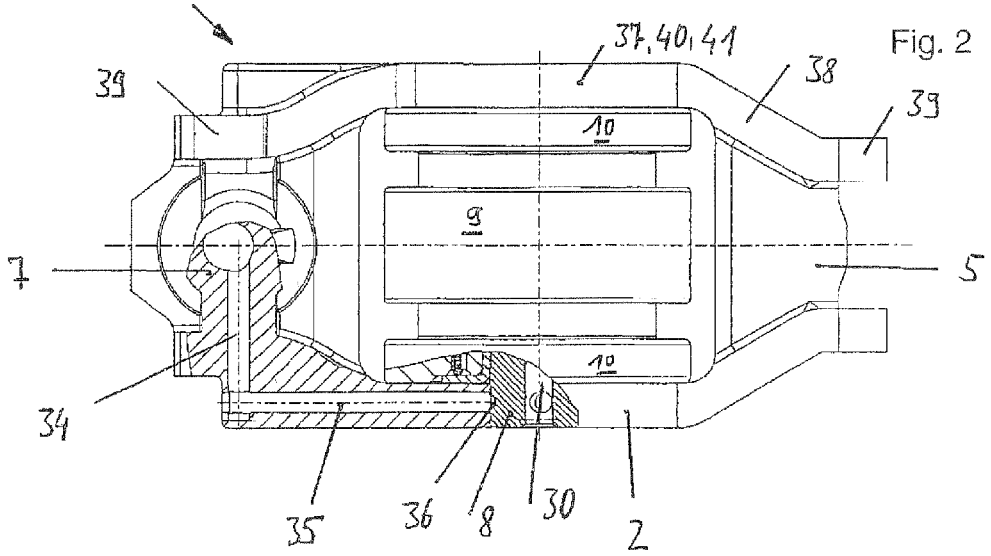
FIG. 2 shows a top view according to FIG. 1.

It can also be gathered from FIG. 2 that upper sides 40 of the side walls 2 have support surfaces 41, via which the lever 1 can be supported, as it passes through the cam base circle on a mating surface, which is connected to a cylinder head of the internal combustion engine, or on support cams, in such a manner that the cam rollers 9, 10 of said lever, as they pass through the cam base circle, run with play with respect to the base circle of the counter running cams.

Figure 4:
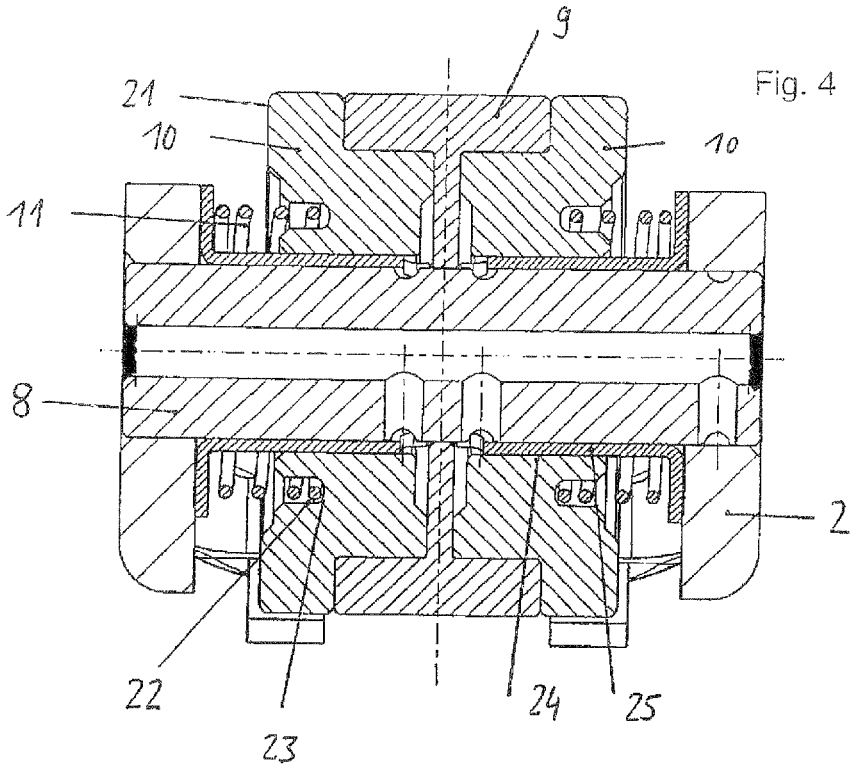
FIG. 4 shows a cross section through the lever in the region of the axle with the cam rollers in a second position (low cam lift)
Figure 5:
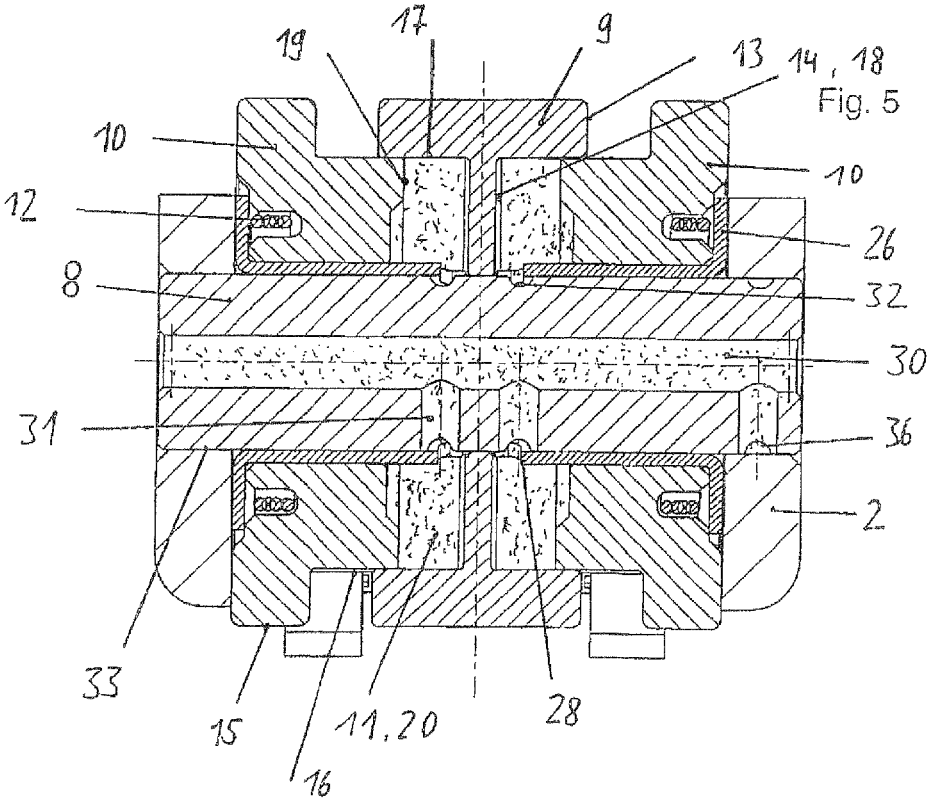
FIG. 5 shows the cross section as previously, but with the cam rollers in the first position (large cam lift).

If, when passing through the cam base circle, the lever 1 is to be switched over to a low cam lift, then, as FIG. 4 shows, the high pressure at the hydraulic medium 11 in the pressure space 20 is switched off, and therefore the high-lift cam rollers 10 are moved toward each other by the force of the spring means 11 thereof and come into contact by the inner faces 19 thereof with the base 18 of the pockets 14 of the low-lift cam roller 9. The high-lift cams located on both sides of the central low-lift cam are then not in engagement with the first diameter steps 15 of the high-lift cam rollers.

In order to switch back (see FIG. 5), during the running through the cam base circle, the high pressure at the hydraulic medium 11 in the pressure space 20 is switched on, and therefore the high-lift cam rollers 10, pressed away from each other, run onto the radial collar 26 of the pipe section 25. The cam rollers 10 are therefore located below the respective high-lift earn, and the lever 1 follows the latter.

LIST OF REFERENCE NUMBERS

1) Lever
2) Side Wall
3) One End
4) Other End
5) Crossbar
6) Gas-Exchange Valve System
7) Bearing
8) Axle
9) Low-Lift Cam Roller
10) High-Lift Cam Roller
11) First Servo Means, Hydraulic Medium
12) Second Servo Means, Spring Means
13) End Side
14) Pocket
15) Diameter Step
16) Diameter Step
17) Annular Casing
18) Base
19) Inner Face
20) Pressure Space
21) Outer Face
22) Annular Pocket
23) Bottom
24) Bore
25) Pipe Section
26) Radial Collar
27) Inner Side
28) Inner Face
29) Aperture
30) Axial Channel
31) Radial Channel
32) Annular Groove
33) Outer Casing
34) Transverse Channel
35) Longitudinal Channel
36) Overflow
37) Center Section
38) Intermediate Section
39) End Section
40) Upper Side
41) Support Surface

The invention claimed is:

1. A switchable lever for a valve drive of an internal combustion engine, comprising:

an elongated housing having two side walls, one end of the housing having a crossbar for a gas-exchange valve system and another end of the housing for a bearing;

an axle transverse to and fixed in the housing;

an axially fixed low-lift cam roller rotatable on, centrally positioned and concentric with the axle;

high-lift cam rollers flanking the axially fixed low-lift cam roller on each side of the axially fixed low-lift cam roller, the high-lift cam rollers being transversely displaceable between a first position and a second position;

a first servo device actuatable for positioning the high-lift cam rollers in the first position where the high-lift cam rollers displaced away from each other on the axle; and a second servo device actuatable for positioning the high-lift cam rollers in the second position where the high-lift cam rollers displaced toward each other on the axle.

2. The lever according to claim 1, wherein the low-lift cam roller has a cylindrical pocket on both of the end sides, and each of the high-lift cam rollers has two diameter steps, an axially outer diameter step for high-lift cam contact and an axially inner diameter step, which is smaller in diameter than the axially outer diameter step, is mounted together in sections with an annular casing of the pocket of the low-lift cam roller.

3. The lever according to claim 2, wherein the first means is a pressure space for hydraulic medium that can be introduced via the axle, the pressure space is formed axially between bases of the cylindrical pockets and an inner faces of the high-lift cam rollers.

4. The lever according to claim 3, wherein the first position is achieved by a high pressure of the hydraulic medium conducted into the pressure space.

5. The lever according to claim 2, wherein the second means is a mechanical spring means that is clamped, at least indirectly, between outer faces of the high-lift cam rollers and inner faces of the sidewalls.

6. The lever according to claim 5, wherein the second position is achieved when a high pressure of hydraulic medium is switched off.

7. The lever according to claim 5, wherein the outer faces of the high-lift cam rollers each have a concentric annular pocket and the spring means is supported at each end in each pocket.

8. The lever according to claim 7, wherein the annular pockets are formed radially inward of the inner diameter step of the high-lift cam roller.

9. The lever according to claim , wherein the spring means is at least one helical compression spring.

10. The lever according to claim 5, further comprising pipe sections seated on the axle, each of the pipe sections has a radial collar which bears against each of the sidewalls.

11. The lever according to claim 10, wherein the high-lift cam rollers each have a bore and are each non-rotatably seated on the pipe section, and the low-lift cam roller is held on both sides between inner faces of the pipe sections, which oppose the radial collar to ensure central positioning of the low-lift cam roller on the axle.

12. The lever according to claim 10, wherein the spring means is supported on an inner face of the radial collar of the pipe section.

13. The lever according to claim 10, wherein the pipe section has an inner face with crown-shaped apertures for an overflow of hydraulic medium into the pressure space, the hydraulic medium can be conducted away from an axial channel.

14. The lever according to claim 13, further comprising a supply line for hydraulic medium having a transverse channel in the crossbar, a longitudinal channel in one of the side walls and an annular-groove/bore overflow in the axle, the supply line extends outwardly from the bearing at the second end via the transverse channel, the transverse channel opens at an outer end into the longitudinal channel, the longitudinal channel communicates with the annular-groove/bore overflow and from the annular-groove/bore overflow the supply line is conducted further to the axial channel in the axle.

15. The lever according to claim 14, wherein the axial channel has a radial channel, which branches off from the axial channel, the radial channel is positioned axially near a base of the pocket of the low-lift cam roller and extends such that the hydraulic medium can at least partially flow from the radial channel into the pressure space.

16. The lever according to claim 15, wherein the axle has at least one annular groove formed in an outer casing of the axle and the hydraulic medium can be conducted from the axial channel to the radial channel, to the annular groove in the outer casing of the axle and from the annular groove to the apertures of the pipe section and into the pressure space.

17. The lever according to claim 1, wherein the sidewalls have an expanded center section, the center section is adjoined at each end by intermediate sections with inwardly angled contours, and the intermediate sections are adjoined by approximately rectilinear end sections.

18. The lever according to claim 1, wherein the side walls and crossbars are composed of a steel sheet or are produced by metal injection molding.

19. The lever according to claim 1, wherein the lever is a rocker arm lever which has a dome at the one end of the bearing.

20. The ever according to claim 1, wherein the lever is an oscillating lever which has an eye at the another end for the pivotable mounting on the axle.

* * * * *